US005334113A

United States Patent [19]

Roepke

[11] Patent Number: 5,334,113

[45] Date of Patent: Aug. 2, 1994

[54] MULTI-POSITION GRIP SYSTEM FOR BARBELLS

[76] Inventor: Ronald W. Roepke, 216 E. Hazelwood, Waterville, Kans. 66548

[21] Appl. No.: 989,552

[22] Filed: Dec. 11, 1992

[51] Int. Cl.[5] ..... A63B 21/075

[52] U.S. Cl. ..... 482/106; 482/108; 482/49

[58] Field of Search ..... 482/83, 92–94, 482/104, 106, 107, 108, 109, 133, 142, 148, 49–50, 126

[56] References Cited

U.S. PATENT DOCUMENTS

| | | | |
|---|---|---|---|
| Re. 33,218 | 5/1990 | Twardosz . | |
| 3,336,029 | 8/1967 | London | 482/146 |
| 3,384,370 | 3/1968 | Bailey et al. . | |
| 3,936,047 | 2/1976 | Brandt et al. | 482/146 |
| 4,529,197 | 7/1985 | Gogarty . | |
| 4,629,184 | 12/1986 | Selkee . | |
| 4,690,400 | 9/1987 | Metz . | |
| 4,822,035 | 4/1989 | Jennings et al. . | |
| 5,024,434 | 6/1991 | Smith . | |
| 5,116,297 | 5/1992 | Stonecipher . | |

*Primary Examiner*—Richard J. Apley
*Assistant Examiner*—Jerome W. Donnelly
*Attorney, Agent, or Firm*—Litman, McMahon & Brown

[57] ABSTRACT

A multi-position grip system for a weight machine, barbells or the like includes a pair of circular rings, rotatably intercoupled by a bar and axially coupled with a pair of weight-supporting bars fitted with weights, each ring being concentrically and rotatably coupled with a pair of arcuate members in a manner to provide multiple axes for rotation of a handgrip spanning the ends of the inner arcuate member. The grip system may be adapted for use with a bench or weight machine by omitting the weight-supporting bars, substituting additional hemiarcuate members for the rings, and coupling the weight machine with the center bar. A pulleybar may be substituted for the center bar. Members having about a 90° arc may be employed for use with a weight machine by concentrically and rotatably coupling them end-to-end.

16 Claims, 1 Drawing Sheet

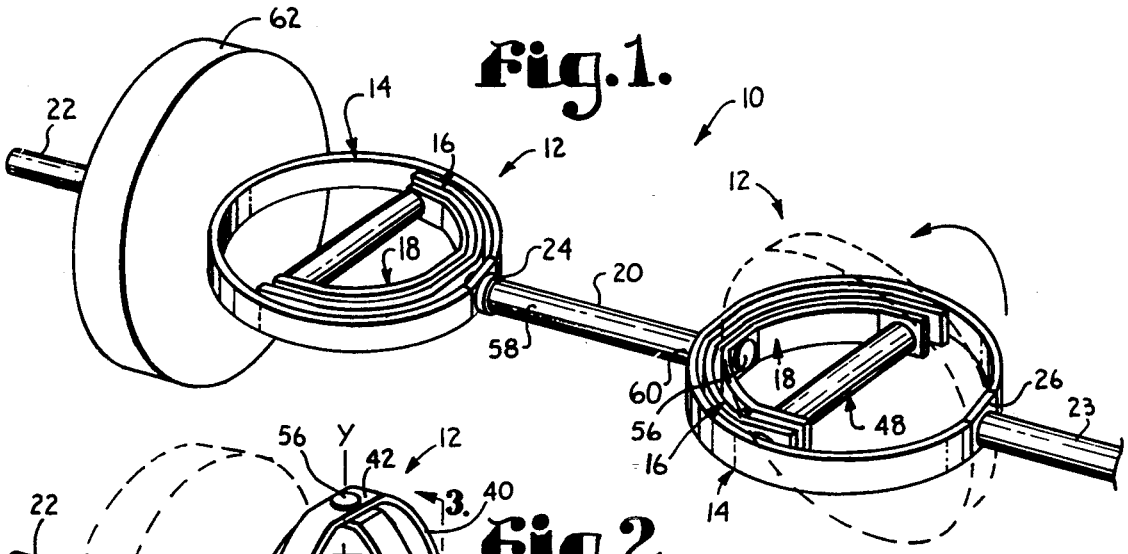
Fig.1.
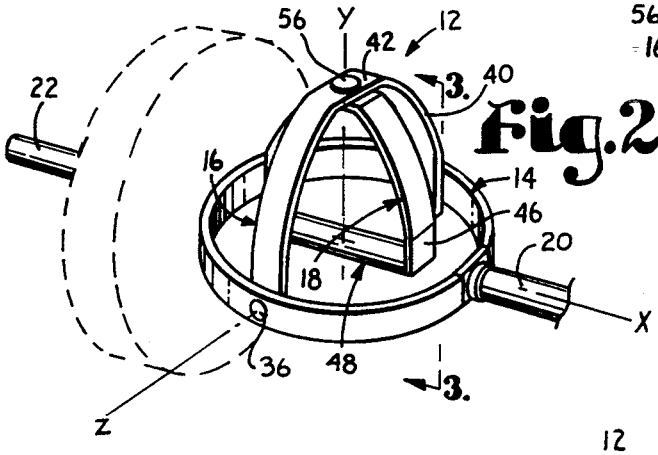
Fig.2.
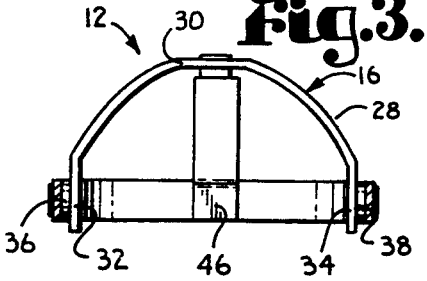
Fig.3.
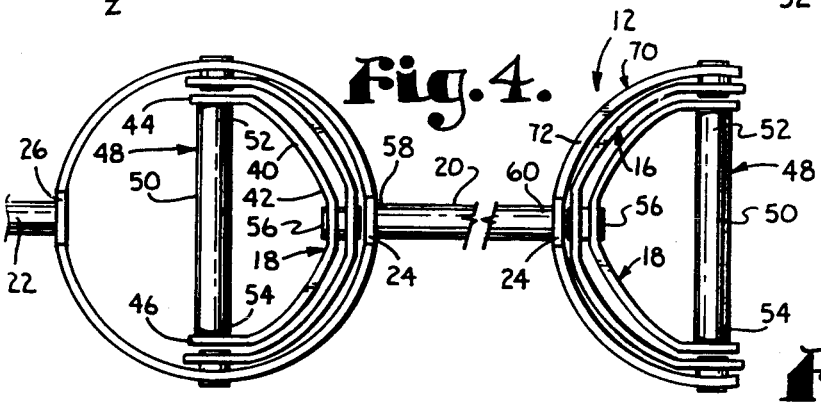
Fig.4.
Fig.4a.
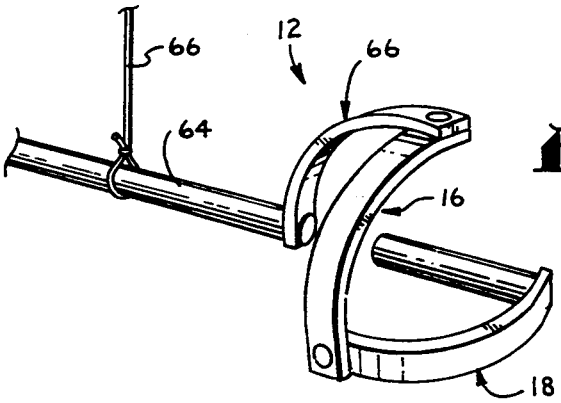
Fig.5.

MULTI-POSITION GRIP SYSTEM FOR BARBELLS

BACKGROUND OF THE INVENTION

1. Field of the Invention

The present invention relates generally to a multi-position grip system for a weight machine, barbells or the like which permits a user to perform the multi-axis hand rotation possible with single-handed dumbbells while at the same time achieving the balance and control of two-handed devices such as barbells, pulley bars, and weight machines. More particularly, it is concerned with a grip system having a handgrip and a series of arcuate members concentrically and rotatably coupled to present three rotational axes, which permit continuous multi-axis hand and wrist movement of a user throughout the range of motion in a variety of exercises.

2. Description of the Related Art

In recent years weight lifting has become an increasingly popular form of exercise. Most weight training exercises can be performed using either one-handed dumbbells, consisting of a short bar with weights at either end, or two-handed barbells consisting of a straight bar with weights at both ends.

Since one dumbbell is held in each hand, a user can freely rotate the wrist and hand throughout the full range of motion as an exercise is performed. For example, in performing a shoulder press with dumbbells, a user holds a dumbbell in each hand directly beside the shoulders, with palms facing toward each other. The dumbbells are raised over the head and the palms are rotated to face forward. The palms are rotated back to the starting position as the weights are lowered.

The same exercise can be performed with a barbell by grasping the bar with an overhand grip, straightening up and lifting the weight to shoulder level, then lifting the bar up over the head. Heavier weights can be lifted using the barbell because it permits greater balance and control. However, the hands and wrists must be held in a relatively fixed position, and may be rotated only along the axis of the bar. Thus, it is not possible to use a standard barbell to exercise the groups of muscles involved in pronation and supination as with dumbbells. Moreover, the necessity of maintaining such a fixed position during exercises with the heavier barbell increases strain on the wrists and elbows. In addition, safety is compromised by the inability to reposition grip in the midst of a lift or exercise to obtain better control.

Prior art devices have attempted to impart some wrist rotation to the standard barbell, but do not provide a full range of motion for a user and are generally not adaptable for attachment to a weight or similar exercise machine. U.S. Pat. No. 4,690,400 issued to Metz permits rotation of handles along the same axis as the bar; U.S. Pat. No. 3,384,370 issued to Bailey; U.S. Pat. No. 4,822,035 issued to Jennings; U.S. Pat. No. 5,024,434 issued to Smith; and 33,218 reissued to Twardosz permit rotation of handles on a single axis perpendicular to the rod. U.S. Pat. No. 4,629,184 issued to Selkee permits rotation of handles along a pair of axes.

SUMMARY OF THE INVENTION

The present invention overcomes the problems previously outlined and provides a greatly improved grip system with practically infinite adjustability of handle positions with respect to multiple axes. Broadly speaking, the multiposition grip system includes a pair of circular rings, rotatably intercoupled by a bar and axially coupled with a pair of weight-supporting bars fitted with weights, each ring being concentrically and rotatably coupled with a pair of arcuate members in a manner to provide multiple axes for rotation of a handgrip spanning the ends of the inner arcuate member. Particularly preferred forms are adapted for use with a weight-machine by omitting the weight-supporting bars and substituting additional hemiarcuate members for the rings. The weight machine is coupled with the center bar by means of a bar fitting or cable reeved about a pulley. A specialized pulleybar may also be substituted for the center bar. In still other preferred forms, arcuate members of about 90° are employed for use with a weight machine and are concentrically and rotatably coupled end-to-end.

OBJECTS AND ADVANTAGES OF THE INVENTION

The principal objects and advantages of the present invention include: providing a multi-position grip system which can be used on a variety of equipment such as weight handle; providing such a system which permits adjustment of the spacing between handles; and providing such a system which permits inward and outward rotation of the wrists with respect to the body.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of the apparatus of the invention for use with barbell weights with concentric rings and arcuate members shown nested in a planar relationship and rotation of one of the outer rings shown in phantom;

FIG. 2 is a fragmentary perspective view showing the arcuate members and their respective rotational axes, with a weight disk shown in phantom;

FIG. 3 is a sectional view taken along line 3—3 of FIG. 2;

FIG. 4 is a top plan view of the apparatus of FIG. 1;

FIG. 4*a* is a top plan view with parts broken away of an embodiment having handles for use with a weight machine; and FIG. 5 is a perspective view of an alternate embodiment employing 90° arcuate members.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring now to the drawing, a multi-position grip system 10 includes a pair of handle assemblies 12 which define a pair of generally open-centered or circular first frame members races 14, each concentrically coupled with a semicircular or other suitably configured intermediate housing 16, which is in turn concentrically coupled with a semicircular or other suitably configured inner housing 18. A pair of handle assemblies 12 are intercoupled by a central support bar 20. Weight support bars 22, 23 are axially coupled in opposed in-line relationship to form a barbell-type weight system.

In more detail, outer race 14 includes a pivotal support bar coupling 24 and an opposed weight support coupling 26. As best shown in FIGS. 2 and 3, intermediate housing 16 includes a semicircular arcuate member 28 having a bight portion 30 interconnecting a pair of opposed ends 32, 34 which define a Z-axis. Housing 16 is coupled with race 14 by a pair of Z-axial pivots 36,38.

As best shown in FIGS. 2 and 4, inner housing 18 includes an arcuate member 40 having a bight portion 42 interconnecting a pair of opposed ends 44, 46. Handgrip 48 has a center 50 and a pair of opposed ends 52, 54 which are fixedly coupled to ends 44, 46. Inner housing bight portion 42 is coupled with intermediate housing bight portion 30 at pivot point 56, which defines a Y-axis passing through handgrip at center 50.

Central support bar 20 defines an X-axis which is generally perpendicular to the Z-axis. The Y-axis is likewise generally perpendicular to the Z-axis. The Y-axis is variable with respect to the X-axis between about 0° and about 180°, preferably between about 0° and about 90° during use when intermediate housing 18 is rotated about the Z-axis.

Central support bar 20 includes a pair of opposed ends 58, 60, each of which is pivotally coupled to a race 14 at a coupling 24. Weight support bars 22 each include a generally disk-shaped weight 62 and a locking member (not shown) of conventional construction. Those skilled in the art will appreciate that any number of disks of varying weights may be installed on support bars 22, 23.

As best shown in FIG. 5, alternate embodiments employ a pulleybar 64 in lieu of weight support bars 22, 23 and central support bar 20. Pulleybar 64 is attached to a cable or tension line 66 which is reeved about a pulley attached to a bench or weight machine. In such embodiments a semicircular arcuate housing 66 of about 90° is substituted for race 14. Where an arcuate housing of about 90° is employed, intermediate and inner housings 16, 18 are similarly configured. In still other embodiments as best shown in FIG. 4*a*, central support bar 20 may be directly or remotely coupled with a weight machine. In such embodiments outer race 14 is replaced by a generally semicircular arcuate outer housing 70 having a bight portion 72 interconnecting a pair of opposed ends coupled with intermediate housing 16 at Z-axial pivots 36, 38.

Race 14, outer intermediate, and inner housings 70, 16, 18 are preferably formed of metal, with 1"×3/16" flat iron being especially preferred, although any material of suitable tensile strength may be employed. Bars 20, 22, 23 and handgrip 48 are preferably formed of tubular metal of suitable strength. Handgrip 48 may be knurled and grooved to aid in gripping. Axial pivotal couplings 24, 36, 38, and 56 preferably employ combination bearings which can withstand both thrust and radial forces. In addition, bushings or washers may also be employed. Fixed weight support couplings 26 and handle end couplings 52, and 54 may be welded or bolted into place.

In operation, a user selects a central support bar 20 of appropriate length and couples it with a pair of handle assemblies 12. The grip system 10 may be coupled with a bench or weight machine or used with one or more pairs of weights attached to support bars 22 in the manner of a barbell.

In the latter case, to perform an exercise like a shoulder press the user grasps handgrips 48 with an overhand grip, rotating handgrips 48 about the Y-axis, intermediate housing 16 about the Z-axis, and race 14 about the X-axis until the concentrically nested race and housings are rotated to a configuration approximating that depicted in FIG. 2 and a comfortable lifting position is achieved. The lifter then straightens up and lifts the weight to shoulder level while rotating the grip system about the X, Y, and Z-axes to adjust the position of the wrists and elbows to continuously shift the grip to maintain balance. The bar is then lifted up, over the head, and the process is reversed to lower the bar to the starting position.

In this manner, the user is able to position the hands at any point along the three axes so that the muscles appropriate to the exercise are worked, as for example, during exercises requiring pronation and supination of the forearms. This ability to continuously reposition the grip in the midst of the lift to obtain better balance and control enhances safety and reduces strain on the wrists and elbows.

Those skilled in the art will appreciate that this barbell exercise is illustrative only and any number of other lifting exercises using barbells, benches and weight machines employing the multi-position grip system of the present invention are possible. Moreover, the grip system is versatile and can be used on a variety of other equipment such as bicycles, lawn mowers, row boats, or the like.

It is to be understood that while certain forms of the present invention have been illustrated and described herein, it is not to be limited to the specific forms or arrangement of parts described and shown.

What is claimed and desired to be secured by Letters Patent is as follows:

1. A multiposition grip system for use with a weight machine or the like, comprising:

(a) a first generally arcuate member having a pair of opposed ends connected by a bight portion;

(b) an elongate bar having a pair of opposed ends, one of said ends being rotatably coupled with said bight portion for rotation of said first member about a first axis defined by said bar, said bar including weight attachment means;

(c) a second generally arcuate member having a pair of opposed ends connected by a second bight portion, said second ends being concentrically and rotatably coupled with said first ends for rotation of said second member about a second axis defined by said first and second ends;

(d) a third generally arcuate member having a handgrip portion coupled with a third bight portion, said third bight portion being concentrically and rotatably coupled with said second bight portion for rotation of said third member about a third axis intersecting said second and third bight portions; and (e) means permitting the cooperative rotation of said first, second, and third members to permit rotation of said handgrip about said three axes during use.

2. The apparatus as set forth in claim 1, wherein said second axis is perpendicular to said first and third axes and said first and third axes are variable between about 0° and about 90° when said second member is rotated about said second axis.

3. The apparatus as set forth in claim 1, wherein said axes intersect at the center of said handgrip.

4. The apparatus as set forth in claim 1 further including pairs of first, second, and third arcuate members rotatably intercoupled by said elongate bar to permit independent rotation of each of a pair of opposed handgrips about three axes during use.

5. The apparatus as set forth in claim 4 wherein said bar is interchangeable with bars of varying lengths.

6. The apparatus as set forth in claim 4, wherein said first members are generally circular in shape.

7. A multiposition grip system for use with barbells or the like, comprising:

(a) a pair of generally circular first members;

(b) an elongate bar rotatably intercoupling said first members in linear relationship for rotation of said members about a first axis defined by said bar;

(c) a pair of elongate weight-supporting bars axially coupled with said circular members in opposed relationship with said first bar, said bars each including weight attachment means;

(d) a pair of second generally arcuate members, each having a pair of opposed ends connected by a bight portion, said second ends being concentrically and rotatably coupled with said circular members for rotation of said second members about a pair of second axes defined by said second ends perpendicular to said first axis;

(e) a pair of third generally arcuate members, each having a handgrip portion coupled with a third bight portion, said third bight portions being concentrically and rotatably coupled with said second bight portions for rotation of said third members about a pair of third axes intersecting said respective second and third bight portions; and (e) means permitting cooperative rotation of said first, second, and third members to permit independent rotation of each of said handgrips about said three axes during use.

8. The apparatus as set forth in claim 7 wherein each of said second axes is perpendicular to said respective first and third axes and said first and third axes are variable between about 0° and about 90° when each of said second members is rotated about said respective second axis.

9. The apparatus as set forth in claim 7 wherein said axes intersect at the center of said handgrip.

10. The apparatus as set forth in claim 7 wherein said intercoupling bar is interchangeable with bars of varying lengths.

11. The apparatus as set forth in claim 7 further including means for locking said weights on said weight bars.

12. A multi-position grip system for use with barbells or the like, comprising:

(a) a pair of generally open-centered first frame members;

(b) an elongate bar rotatably intercoupling said first frame members in linear relationship for rotation of said members about a first axis defined by said bar;

(c) a pair of elongate weight-supporting bars axially coupled with said first frame members in opposed relationship with said first bar, said bars each including weight attachment means;

(d) a pair of second bail members, each having a pair of opposed ends connected by a bight portion, said second ends being concentrically and rotatably coupled with said first frame members about a pair of second axes defined by said second ends perpendicular to said first axis;

(e) a pair of third bail members, each having a pair of opposed ends connected by a bight portion, said third ends being coupled with a handgrip portion, said third bight portions being concentrically and rotatably coupled with said second bight portion for rotation of said third bail members about a pair of third axes intersecting said respective second and third bight portions; and (f) means permitting cooperative rotation of said first frame, second, and third members to permit independent rotation of each of said handgrips about said three axes during use.

13. The apparatus as set forth in claim 12, wherein each of said second axes is perpendicular to said respective first and third axes and said first and third axes are variable between about 0° and 90° when each of said second members is rotated about said respective second axis.

14. The apparatus as set forth in claim 12 wherein said axes intersect at the center of said handgrip.

15. The apparatus as set forth in claim 12 wherein said intercoupling bar is interchangeable with bars of varying lengths.

16. The apparatus as set forth in claim 12 further including means for locking said weights on said weight bars.

* * * * *